United States Patent [19]

Clarke

[11] Patent Number: 4,824,270

[45] Date of Patent: Apr. 25, 1989

[54] DISPENSERS FOR FLOWABLE COMPOSITIONS

[75] Inventor: Frederick Clarke, Huddersfield, England

[73] Assignee: Clantex Limited, Leeds, England

[21] Appl. No.: 894,915

[22] Filed: Aug. 8, 1986

[30] Foreign Application Priority Data

Aug. 9, 1985 [GB] United Kingdom ..... 8520043

[51] Int. Cl.[4] ..... B05C 17/00

[52] U.S. Cl. ..... 401/48; 401/193; 401/266; 222/567

[58] Field of Search ..... 401/48, 174, 176, 193, 401/261, 263, 265, 266, 9; 222/566, 567; 118/410

[56] References Cited

U.S. PATENT DOCUMENTS

| | | | |
|---|---|---|---|
| 1,150,536 | 8/1915 | Reiser et al. | 401/188 |
| 2,754,033 | 7/1956 | Etter | 222/326 |
| 3,058,632 | 10/1962 | Stremmel | 222/567 |
| 3,173,166 | 3/1965 | Christensen | 118/410 X |
| 3,536,411 | 10/1970 | Eisert | 401/176 |
| 3,653,560 | 4/1972 | Adams et al. | 401/9 |
| 4,182,264 | 1/1980 | Gibson et al. | 401/147 X |
| 4,508,245 | 4/1985 | Houlbrook et al. | 401/174 X |

*Primary Examiner*—V. Millin
*Assistant Examiner*—Franklin L. Gubernick
*Attorney, Agent, or Firm*—Fred Philpitt

[57] ABSTRACT

This invention provides a plastic disposable nozzle tube for a dispensing cartridge, itself disposable, so that the cartridge and nozzle tube can be disposed of after use. The cartridge contains crease setting composition which is dispensed through the nozzle tube and into a crease in a garment which is to be permanently set by the composition. The nozzle tube is pushed into a transverse bore in the cartridge and comprises a tube portion received in the bore and a shoe portion which is push fitted onto one end of the tube portion in a unique position of alignment and is connected thereto. The other end of the tube portion is closed by a plug pushed into the tube portion and connected thereto. Also provided is a nib portion having a rearwardly extending fin having a portion which engages a guide plate attached to the cartridge.

6 Claims, 3 Drawing Sheets

DISPENSERS FOR FLOWABLE COMPOSITIONS

This invention relates to dispensers for flowable compositions which use disposable cartridges of which one type is described in European Pat. No. 0059413, and another type is disclosed in U.S. Pat. No. 4,182,264.

Cartridges of the type disclosed in said European patent, and referred to herein as "cartridges of the first type" are normally of plastics material and comprise an elongated hollow body for receiving the composition to be dispensed, and at one end they have a discharge outlet and at the other end they have or are for receiving a piston which, when displaced along the interior of the cartridge body displaces the composition out of the discharge outlet into a bore which lies transversely to the length direction of the cartridge body. This transverse bore is for receiving a nozzle tube, the nozzle tube having a tube body which is being received in said bore, and is being arranged to receive the displaced composition and to discharge it to a nib end of the nozzle tube from which the composition ejects laterally of the cartridge into, for example, a crease of a garment, the composition in such case being crease setting composition.

In U.S. Pat. No. 4,182,264 there is disclosed a cartridge of a second type, referred to herein as "cartridges of the second type" which have the same features as the first type, except that there is no transverse bore, but instead there is an integral outlet tube providing said discharge outlet, and a nib end is screwed to the integral outlet tube.

Also in U.S. patent application Ser. No. 4,182,264 there is disclosed an applicator for depositing a crease setting composition on the line of an intended crease or an actual crease in a textile fabric or garment, the applicator comprising a cartridge of the second type for the composition, with associated nib end, a rotatable member arranged so as to be engageable with the fabric or garment surface on both sides of the crease line and rotatable by a relative movement between the surface and the applicator, and a mechanism responsive to rotation of the member to urge the composition from the reservoir through the nib end. The said cartridges of the first type, with a nozzle tube, can be fitted to the applicators of U.S. Pat. No. 4,182,264 and can be used in like fashion.

In an alternative arrangement, the applicator may be adapted to be driven by gas under pressure which is used for expelling the composition through the nib end.

The nozzle tube as disclosed in said European Patent is a metallic component which is push fitted into the transverse bore. When the cartridge is exhausted of composition it is disposed of, but the nozzle tube, is removed and cleaned so that it can be re-used. This represents a difficulty insofar as the said crease setting composition is of the type which sets naturally by contact with air, and if the nozzle tube with composition therein is allowed to stand for any length of time, the composition will harden or start to harden, making its removal difficult.

One aspect of the present invention is concerned with the provision of a disposable nozzle tube, and in accordance with the invention there is provided a nozzle tube for use with a flowable composition cartridge of the first type and comprising:

(a) a tube portion for insertion in the transverse bore of the cartridge body so that flowable composition discharged from the cartridge body through the outlet thereof flows into the interior of the tube portion; and (b) a nib portion at one end of the tube portion, said nib portion being hollow and comprising an elongated outlet slot from which the composition passing from the interior of the tube portion into the nib portion can be discharged;

characterised in that the tube portion and the nib portion are of plastics material and the nib portion is a push fit over the tube portion and is secured thereto so that the nozzle tube can be disposed of after use, and in that the nib portion and the tube portion have co-operating means permitting the nib portion and tube portion to be push fitted only in one predetermined position of alignment.

In one arrangement in the said European Patent, the nozzle tube has an end which is of non-circular shape, which engages a section of the transverse bore which is of similar shape in order to align the nozzle tube with the cartridge body, and also to prevent the nozzle tube from turning in use.

Preferably the nozzle tube includes a plug closing the end of the nozzle tube portion remote from said nib portion, and the nozzle tube may include a cranked portion so that the nib portion will lie at the desired angle relative to the crease.

Preferably also, there is a flat on said plug and a flat on the end of said tube portion in which the plug is received, said flats being co-planar to form a locking surface engaging a flat in the transverse bore for keeping the nozzle tube in a predetermined angular alignment when in said transverse bore of the cartridge. The plug may have a rib and the tube portion may have a flat receiving said rib to ensure that the slot of the plug lies in the same plane as the flat on the tube portion.

Preferably also, the nib portion has a cap portion which receives the end of the tube portion, said cap portion being connected to the end of the tube portion received therein. Where the cartridge or the dispenser is provided with a guide means which runs in the crease, said guide extends close to the nib portion, and said nib portion is provided with engagement means which fits to the guide means in order to keep the nib portion in alignment with the guide means and to enhance the rigid support of the nib portion.

For the application of crease setting compositions in creases of garments, it is important that the applicator and the nib portion from which the crease setting composition issues be guided accurately along the line of the crease. To ensure the guiding of the applicator, the applicator has been provided with a guide means which engages and runs in the crease, this guide means typically being in the form of a plate member arranged so that an edge thereof engages said crease, but the aligning of the nib portion has previously been left to the mounting of the nozzle tube in the case of cartridges of the first type and to the mounting of the nib portion on the outlet tube in the case of cartridges of the second type, and this has been found to be insufficient, especially when the applicators are machine driven along the garment creases as opposed to be hand driven, as was the case in the earlier machines for applying crease setting composition.

Another aspect of this invention therefore is concerned with the guiding and stabilizing of the nib portion, and in accordance with this other aspect of the invention, there is provided a nib portion either integral, attached or attachable to a nozzle tube portion for use with a flowable composition cartridge of the first type, or for attachment to an outlet tube of a flowable composition cartridge of the second type, said nib portion comprising a hollow body having an elongated outlet slot from which composition charged into the body can be dispensed as a narrow ribbon, and engagement means for engagement with the guide means of the applicator supporting the cartridge to maintain the outlet slot in alignment with the guide means.

By this engagement of the nib portion and the guide means of the applicator, the applicator can be power driven and the nib portion will remain in accurate alignment with the garment crease during such driving.

The engagement means may, when the guide means comprises a plate member, comprise a pair of spaced tabs between which the plate member engages.

The nib portion may comprise a cylindrical cap portion which either receives the end of the nozzle tube portion when the nib portion is used with a cartridge of the first type, or receives the outlet tube when the nib portion is used with a cartridge of the second type, leading to a flattened tapered portion defining said outlet slot, the outlet slot lying at an angle to the axis of the cylindrical cap, and said tabs being formed integrally with a fin portion itself integral with the cap and tapered portions.

The nib portion preferably is a one piece plastics moulding.

The nib portion and, when provided, the nozzle tube portion are preferably formed in a plastics material which does not bond to the said composition when the composition has set.

An embodiment of the present invention will now be described, by way of example, with reference to the accompanying drawings, wherein.

Figure 1:
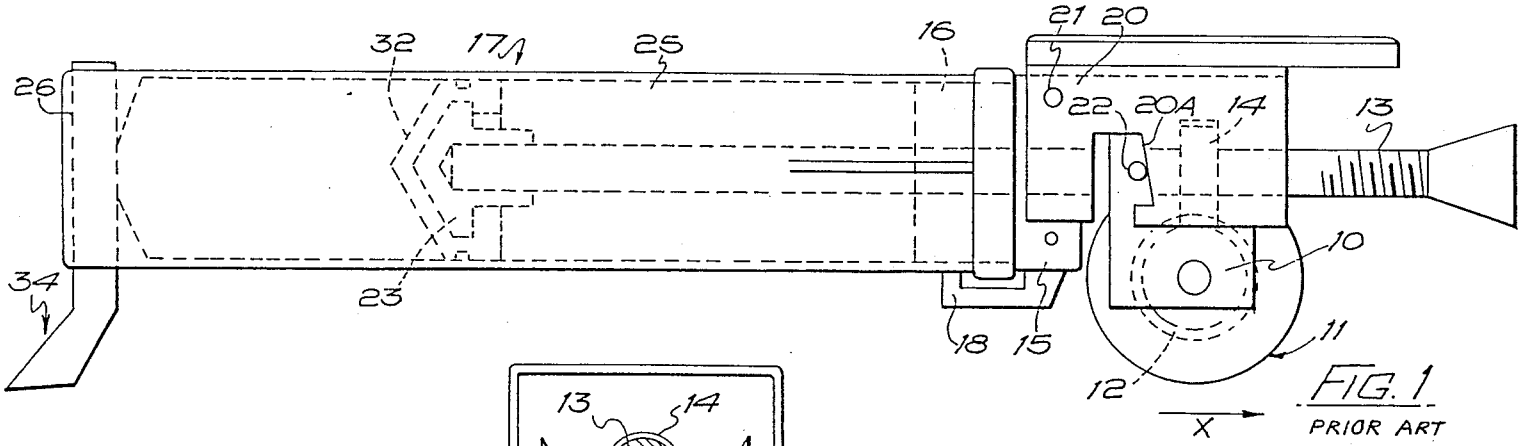
FIG. 1 PRIOR ART
FIG. 1 is a side view of an applicator for crease setting composition as disclosed in said European Patent.
Figure 1A:
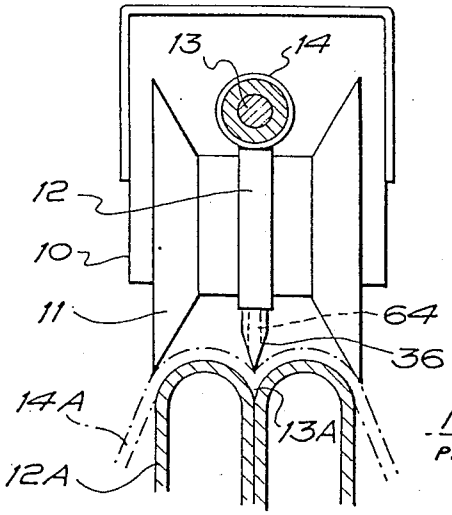
FIG. 1A PRIOR ART
FIG. 1A is a rear view of the applicator shown in FIG. 1.

A complete applicator or dispenser is shown in FIGS. 1 and 1A and comprises a body 10 in which is rotatably mounted a two flange roller 11 which incorporates a worm gear 12. A threaded rod 13 passes slidably through the body 10 and carries an internally threaded and externally toothed annular pinion 14, the external teeth of which mesh with worm gear 12 and the internal teeth of which engage with threaded rod 13. A mounting block 15 surrounding the rod 13 and adjacent the body 10 has a cylindrical portion 16 over which a disposable plastics material cartridge 17 containing crease setting composition to be dispensed is removably fitted. The cartridge 17 is locked by a pivoted locking member 18. A rocking link 20 is pivoted on block 15 at 21 and has a surface 20A acting against a pin 22 on the body so that rocking of the link causes the body 10 to be brought into greater proximity with the block 15 in the direction of arrow X against the action of an internal spring.

The end of the rod 13 which projects beyond the block 15 carries a piston body 23. This mechanism and its operation form no part of the present invention but are fully described in the aforesaid U.S. Patent, and reference is made thereto for specific details.

FIG. 1A shows how the two flanges of roller 11 engage the edges of a table member 12A having a central groove 13A. A garment 14A with a crease therein e.g. a trouser leg is trapped between the roller 11 and table member 12A so that-the crease lies in said groove 13A and exactly registers with a nozzle tube as explained herein so that as the applicator is moved in the direction of arrow X; crease setting composition is exuded from the nozzle tube into the crease in a controlled fashion.

Figure 2:
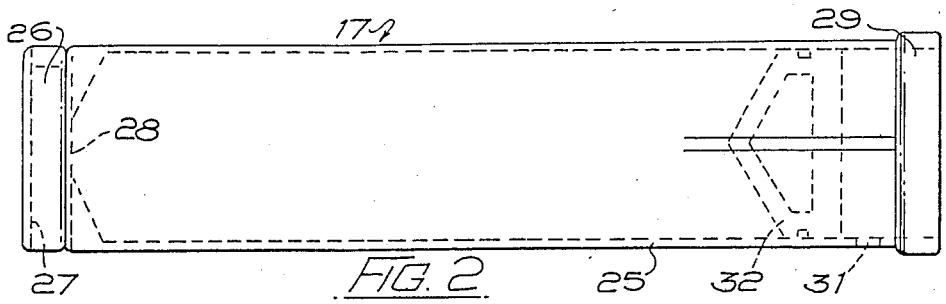
FIG. 2 PRIOR ART
FIG. 2 is a more detailed side elevation of the cartridge of FIG. 1.
Figure 3:
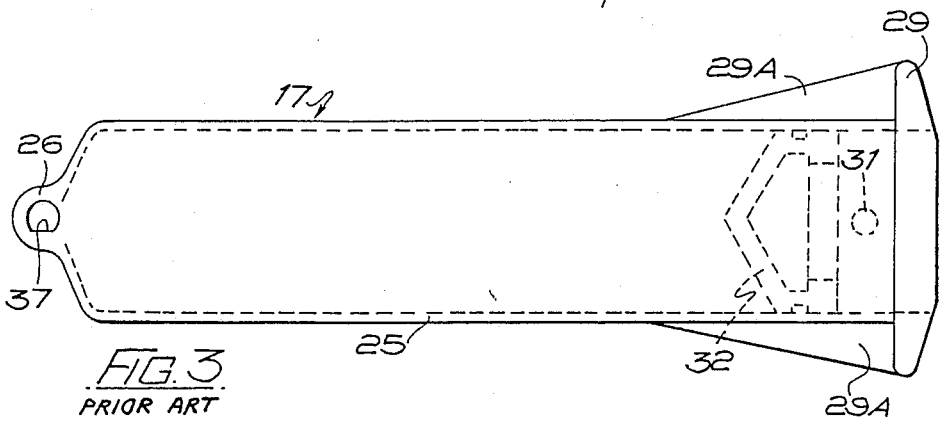
FIG. 3 PRIOR ART
FIG. 3 is a top plan view of the cartridge of FIG. 2.
Figure 4:
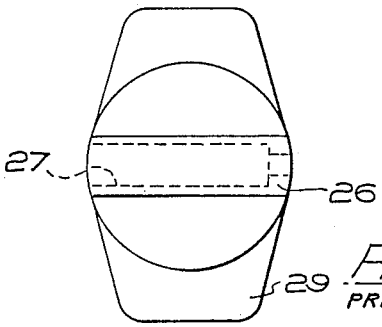
FIG. 4 PRIOR ART
FIG. 4 is an end elevation of the same cartridge.

The cartridge 17 is better seen in FIGS. 2 to 4 and comprises a body including a hollow cylindrical portion 25 which is open at one end but is provided at the other end with a nozzle tube supporting body in the form of a transverse dispensing housing 26 which is of rigid plastics material and is much thicker than the cylindrical portion 25, and is also formed with a transverse bore 27 extending perpendicularly to the longitudinal axis of the portion 25 intersecting the interior of the body at a discharge opening 28. The opening 28 is of circular shape and the interior of the portion 25 is conical at the nozzle end. The bore is made to intersect the apex of the cone so that the diameter of the discharge opening 28 is less than the diameter of the bore 26. The body is preferably moulded integrally with the housing (which is solid plastics material) from a suitable synthetic resin, such as polypropylene. An integrally mounted flange 29 with fins 29A at the open end of the body strengthens the end and provides convenient purchase when fitting the cartridge to and removing it from the applicator mechanism. A hole 31 is provided to receive the locking member 18 to retain the cartridge in position.

A piston seal 32 of generally conical form is slidable but is a tight fit inside the body 17 and serves as a closure for the open end of the body to retain the contents of the body out of contact with the air. The seal 32 may be of the non-reversible type to prevent the cartridge from being re-filled. It is shaped to co-operate with the piston body 23 when the latter is inserted into the cartridge as the cartridge is fitted to the dispenser mechanism, and then serves to expel composition from the body as the piston 23 is driven along the body by the applicator mechanism, in the manner as described in the said U.S. patent.

Figure 2A:
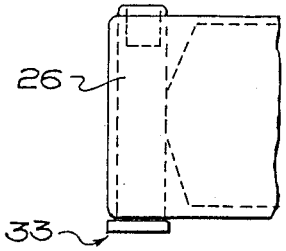
FIG. 2A PRIOR ART
FIGS. 2A and 2B show the dispensing end of the cartridge fitted respectively with a sealing plug and a dispensing nozzle, FIG. 2B being a sectional view.

The above description relates to the known arrangement as set forth in said European patent, and FIG. 2 shows that according to the arrangement in the said European Patent, the cartridge is sealed during storage by a closure plug or peg 33 (FIG. 2A) which is a tight fit in the bore 27 and thus closes off the opening 28. The peg is in fact made of a somewhat less rigid material than the body 26, for example being moulded from plasticised polyvinyl chloride, and therefore the plug 33 bulges into the opening 28 and thus will form an excellent seal at the opening 28.

Figure 2B:
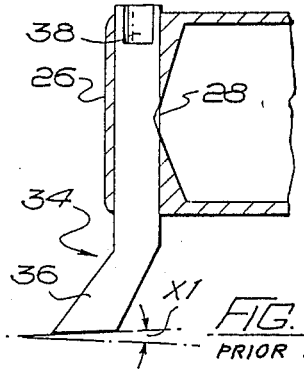
FIG. 2B PRIOR ART

When the known applicator is to be used, the cartridge 17 is fitted on the block 15 and locked into position by member 18. The piston 23 is then advanced down the body 25 by rotation of threaded rod 13 until it engages and then seats firmly in the seal 32. The peg 33 is then removed from the bore and replaced by a steel nozzle tube 34 which simply plugs into the end of the bore 26 as shown in FIG. 2B. The tube 34 is closed at its upper end, but at its lower end it is formed with a broadened nib portion 36 terminating in a straight, narrow slot. FIG. 1A shows how the nib portion 36 registers with the table groove 13A, which is important for the accurate dispensing of the composition. An opening in the side wall of the tube 34 is provided at a position where it will register with the opening 28 into the body 25. The applicator is then ready for use, but a desirable degree of pressure on the contents of the cartridge can be applied by actuating the rocking link 20.

In an alternative applicator mechanism, instead of utilising the wheel and gear arrangement described and shown in FIG. 1, a pneumatic actuator may be used for driving a piston member 32 along the inside of the cartridge body 25.

The most uniform application of crease setting composition, and thus the formation of the most satisfactory permanent creases, is achieved when the nozzle slot is accurately positioned in a longitudinal direction and in alignment with the garment crease. This is achieved in the arrangement of said co-pending application by forming the upper part of the bore 27 with a reduced section having a flat face 37. A corresponding flat face 38 at the upper part of the tube 34 ensures accurate orientation of the nozzle slot, while the relatively massive rigid housing 26 surrounding the tube 34 ensures that there is no significant variation in the inclination of the nozzle slot. The peg 33 to be used with the bore having a flat face should itself have a corresponding flat face at its upper end. The outlet nozzle slot should be at an angle X1 of about 5° to the general plane of the garment in the vicinity of the crease.

When the cartridge as described above is partly exhausted of composition, but its use has ceased for a period, or when it is finally exhausted the nozzle tube 34 is removed, cleaned and re-used. The cartridge 17 is thrown away when empty. The retention and cleaning of the nozzle represents a considerable inconvenience, and the present invention is therefore concerned in one aspect with providing an alternative nozzle tube which may be disposable along with the cartridge 17.

Figure 5:
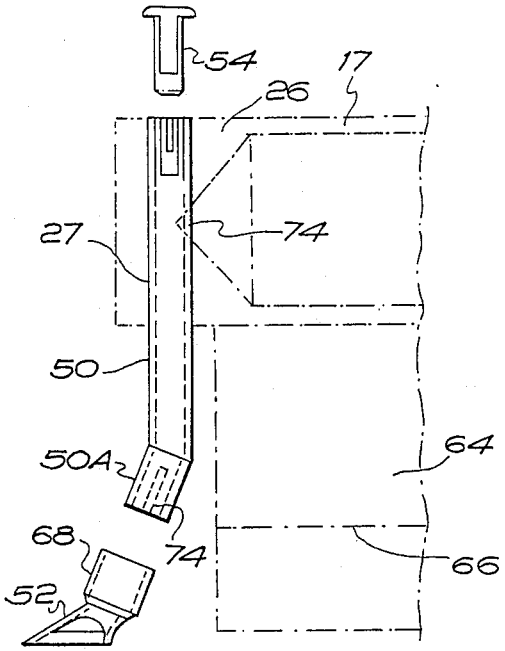
FIG. 5 is an exploded side view of a nozzle tube according to the present invention.
Figure 6:
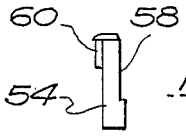
FIG. 6 is a side view of the plug portion of the nozzle tube shown in FIG. 5.
Figure 7:
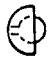
FIG. 7 is a plan view of the plug portion shown in FIG. 6.
Figure 8:
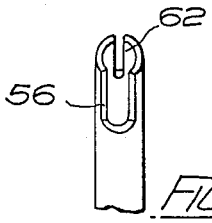
FIG. 8 is a perspective view of the top end of the nozzle tube body portion which receives the plug.

FIG. 5 shows one form of nozzle tube which meets this requirement. The nozzle tube is in three separate portions comprising a body portion 50, a nib portion 52, and a sealing plug 54. FIG. 5 indicates in dotted lines the end 26 of the cartridge body 17, and the transverse receiving bore 27. The body portion 50 has a top end as shown in FIG. 8 with a cut-away defining a flat 56 and the plug 54 also has a flat 58 so that when the plug 58 is inserted in the top end of the body portion 50, the flat 56 and flat 58 lie in the same plane, and form the means similar to flat 38 engaging the flat 37 in the bore 27 preventing the nozzle tube from turning when in the said bore. The plug 54 is preferably cemented in or welded to the top end of the body portion 50. Plug 54 has a key 60 which engages a slot 62 in the top end of the body portion 50. The body portion 50 is shown as being slightly longer than the corresponding nozzle tube 34 in FIG. 2B, and this is because the nozzle tube 50, 52 and 54 is for use with a modified form of applicator provided with a guide means in the form of a ski or guide plate 64 which may be integral with the cartridge or be part of the dispenser and which has a lower edge 66 which engages in the crease (as shown in dotted lines in FIG. 1A) into which the crease setting composition is being applied in order to provide for the effective metering and guiding of the composition into said crease.

Figure 9:
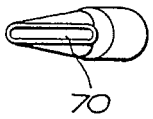
FIG. 9 is an underneath plan view of the nib portion end of the nozzle tube.
Figure 11:
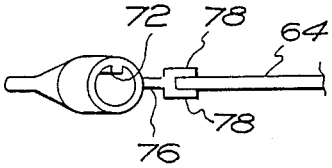
FIG. 11 is a plan view of the nib portion shown in FIG. 10.

At the lower end, the body portion 50 has a slightly cranked portion 50A, and that portion receives the nib portion 52 by virtue of a cup formation 68 of said nib portion 52. The nib portion 52 is cemented or welded to the body portion. Integral with the cup portion 68 is a nib outlet which is of tapering width leading to the narrow outlet slot 70 best shown in FIG. 9. The cup portion 68 as shown in FIG. 11 has an internal key 72 which engages a slot 74 in the cranked portion 50A, to ensure that the nib portion 52 will become properly aligned with the cartridge body and the ski 66. If it is desired to make a shorter nozzle tube, the top of the body portion 50 may be cut to define a body of appropriate length, and the new top end re-shaped as indicated in FIG. 8.

The body portion 50 is provided with an access aperture 74, corresponding to and which registers with aperture 28 to enable composition to flow from the interior of the body 17 into the body portion 50.

Figure 10:
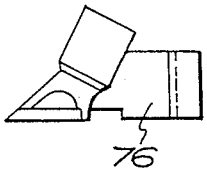
FIG. 10 is a side view of a modified form of nib portion.

FIGS. 10 and 11 show a modified form of nib portion. This modified form includes a rearwardly extending fin 76 integral with the cup formation and nib outlet and which has spaced guide tabs 78 at the rear between which is received the trailing end of the ski or guide plate 64 in order to keep the nozzle end 52 in a correct and exact alignment with the ski or guide plate 64, to enhance the depositing of the composition in the crease. The fin 76, as will be appreciated from FIG. 10 has a lower edge which in use will be in the groove 13A and will assist in maintaining the correct alignment of slot 70 with the crease to be treated which, as explained herein, is very important to the efficient application of the composition to the crease.

The nozzle tube according to the first aspect of the invention as exemplified by the embodiments of FIGS. 5 to 11 may be made in plastics material, so that the tube can be disposed of with the cartridge, thereby overcoming the difficulty of having to remove and clean the non-disposable nibs. Any suitable and inexpensive plastics material which is of a type which will not bond to the flowable composition may be used.

Modifications may be made without departing from the scope of the first aspect of the present invention. For example, where the transverse bore 27 does not extend through the body 26 but is simply a blind bore, the nozzle tube need not have plug 54, nor the aperture 74 but simply could be open at the top and pushed into the bore 27 to an extent to lie under the discharge outlet so that the composition flows directly into the top end of the nozzle tube.

The formation of the nib portion in this manner constitutes a second aspect of this invention, and such nib portion may be formed in metal and may be integral with the nozzle body portion or it may be for connection to a tube outlet of the cartridge of the second type as disclosed in said U.S. Pat. No. 4,182,264.

We claim:

1. A nib portion either integral, attached or attachable to a nozzle tube portion for use with a flowable composition cartridge that is used to dispense a liquid into a crease, said cartridge having a transverse bore for receiving a nozzle tube, or for attachment to an outlet tube of a flowable composition cartridge, said nib portion comprising a hollow body having an elongated outlet slot from which composition charged into the body can be dispensed as a narrow ribbon, and engagement means for engagement with a guide means said guide means being mounted to and projecting from said cartridge and used to guide said cartridge as it moves along a crease whereby the outlet slot is maintained in alignment with the guide means and thereby with the crease.

2. A nib portion according to claim 1, wherein the engagement means comprises a guide fin provided with a pair of spaced tabs between which the guide means engages.

3. A nib portion according to claim 1 or 2, wherein the nib portion comprises a cylindrical cap portion which either receives the end of the nozzle tube portion when the nib portion is used with a nozzle tube portion, or receives the outlet tube when the nib portion is used with a cartridge having an outlet tube, leading to a flattened tapered portion defining said outlet slot, the outlet slot lying at an angle to the axis of the cylindrical portion.

4. A nib portion according to claim 3, wherein the nib portion is a one piece plastics moulding.

5. A nib portion according to claim 4, wherein the nib portion and, when provided, the nozzle tube portion are formed in a plastics material which does not bond to the said composition when the composition has set.

6. The combination of a cartridge and a nib portion as claimed in claim 1, wherein the cartridge has a guide plate integral therewith and the engagement means of said nib portion engages said guide plate maintaining the slot of the nib portion in alignment with a lower edge of the guide plate which is for engagement with a crease in which crease setting composition is to be deposited.

* * * * *